US006145261A

United States Patent [19]

Godfrey et al.

[11] Patent Number: 6,145,261

[45] Date of Patent: Nov. 14, 2000

[54] TONGUE AND GROOVE BOARD INCLUDING A WATER DRAINAGE SYSTEM

[75] Inventors: John E. Godfrey, Providence, R.I.; Nicholas Hughes, Douglastonn, Canada

[73] Assignee: Weyerhaeuser Company Limited, New Brunswick, Canada

[21] Appl. No.: 09/045,277

[22] Filed: Mar. 20, 1998

[51] Int. Cl.[7] ..... E04B 1/70

[52] U.S. Cl. ..... 52/302.1; 52/592.4

[58] Field of Search ..... 52/592.4, 302.1, 52/302.3, 302.4, 533, 592.1; 144/368, 371

[56] References Cited

U.S. PATENT DOCUMENTS

| | | | |
|---|---|---|---|
| 432,245 | 7/1890 | Meigs . | |
| 576,569 | 2/1897 | Gemmer . | |
| 713,577 | 11/1902 | Wickham | 52/592.4 |
| 841,490 | 1/1907 | Montier . | |
| 1,163,613 | 12/1915 | Booraem . | |
| 2,017,185 | 10/1935 | Rockwell | 52/592.4 |
| 2,031,596 | 2/1936 | Fulbright . | |
| 2,227,878 | 1/1941 | Crooks . | |
| 2,430,200 | 11/1947 | Wilson . | |
| 3,552,079 | 1/1971 | Mortensen . | |
| 3,619,961 | 11/1971 | Sterrett et al. . | |
| 3,740,909 | 6/1973 | Stinnes . | |
| 3,818,653 | 6/1974 | Williams . | |
| 4,095,913 | 6/1978 | Pettersson et al. . | |
| 4,807,416 | 2/1989 | Parasin . | |
| 5,182,892 | 2/1993 | Chase . | |
| 5,335,473 | 8/1994 | Chase . | |

*Primary Examiner*—Michael Safavi
*Attorney, Agent, or Firm*—Salter & Michaelson

[57] ABSTRACT

A tongue and grove board has a first surface and a second surface, a first longitudinal edge and a second longitudinal edge and a first transverse edge and a second transverse edge. The first longitudinal edge has a first longitudinal lip and a second longitudinal lip cooperating to form a longitudinal groove therebetween, and the second longitudinal edge has a longitudinal tongue disposed therealong. The board further includes at least one notch disposed in the first longitudinal edge, the at least one notch extending perpendicular to the longitudinal edge, through the first surface and the first lip and partially into the second lip. The at least one notch has a depth at the first surface which is greater than the depth of the groove. The width of the longitudinal tongue is greater than the depth of the longitudinal groove, such that, when the longitudinal groove of the tongue and groove board is interfaced with a longitudinal tongue of an adjacent tongue and groove board, a drain path is formed between the boards, the drain path including the at least one notch in the first longitudinal edge.

8 Claims, 3 Drawing Sheets

TONGUE AND GROOVE BOARD INCLUDING A WATER DRAINAGE SYSTEM

BACKGROUND OF THE INVENTION

1. Field of the Invention

The present invention relates to structural boards used for floors, and in particular, an improved tongue and groove board having a drainage system incorporated into the tongue and groove elements.

2. Description of Related Art

Tongue and groove (T&G) structural boards are well known in the construction industry. They are typically made from plywood, particle board, wafer board, strand board, or other composite wood product materials. Tongue and groove boards are particularly well suited for installation on a joist framing assembly to form a structural sub-floor. T&G boards serve especially well as sub-flooring because of their interlocking edges which reduce vertical offset between adjacent boards resulting in a smoother floor. In addition, the interconnected edges prevent relative movement between adjacent edges as persons walk on the floor, thereby reducing squeaking in the floor. Typically carpet, tile or a hardwood is installed over the structural sub-floor to provide the finished floor surface.

U.S. Pat. No. 4,807,416 to Parasin and U.S. Pat. No. 4,095,913 to Pettersson et al disclose tongue and groove boards incorporating particular tongue and groove shapes and features designed to reduce stresses generated by water absorption along the interconnected edges of adjacent T&G boards, and thereby reduce buckling. However, no provision is made for a means to reduce or prevent the accumulation of water on the upper surface of the sub-floor.

U.S. Pat. No. 2,031,596 to Fulbright discloses tongue and groove boards held together by an embedded spring to form a floor block assembly. U.S. Pat. No. 432,245 to Megis discloses a lumber strip for installation over a sub-floor to form a finished floor surface which incorporates vertical channels spaced along the tongued edge of the strip. The channels are cut into the upper surface of the strip to accommodated blind nailing of the strip to the sub-floor.

U.S. Pat. No. 576,569 to Gemmer and U.S. Pat. No. 3,740,909 to Stinnes disclose wall boards incorporating interlocking grooves to provide a weather tight seal between adjacent boards.

While T&G boards are generally very useful in this application, they are subject to damage if water accumulates on the sub-floor surface during the construction of the building. Water often accumulates in small pools on the assembled sub-floor when rain or snow falls before the building is completed. The result is that the boards may buckle along their edges as the boards and the interlocking edges swell from water absorption.

U.S. Pat. Nos. 5,182,892 and 5,335,473 to Chase disclose a tongue and groove board having notches cut in the tongue portion of the board to provide drainage to prevent the accumulation of water on the boards. However, since the notches are on the tongue portion of the board, only narrow channels along the top and bottom edges of the board are available for allowing the water to drain to and from the notches. Such an arrangement can still cause water damage problems because the water is not able to drain quickly.

A need therefore exists for a T&G board for use in assembling a sub-floor assembly which allows water to quickly drain from the upper surface of the sub-floor, and which is economical to produce.

SUMMARY OF THE INVENTION

A tongue and groove board is disclosed for use in assembling a sub-floor assembly which allows water to quickly drain from the upper surface of the sub-floor, and which is economical to produce without major modification to existing production facilities.

The tongue and groove board of the present invention includes a longitudinal groove having a number of notches cut therein, such that, when water begins to accumulate on the upper surface of the sub-floor, the water is allowed to drain from the sub-floor through the notches provides in the groove portion of the board. The board also includes a number of notches disposed on a transverse edge of the board, to allow for drainage between abutting transverse edges of adjacent boards.

In a preferred embodiment of the invention, a tongue and grove board is disclosed, comprising a first surface and a second surface, a first longitudinal edge and a second longitudinal edge and a first transverse edge and a second transverse edge. The first longitudinal edge has a first longitudinal lip and a second longitudinal lip cooperating to form a longitudinal groove therebetween, and the second longitudinal edge has a longitudinal tongue disposed therealong. The board further includes at least one notch disposed in the first longitudinal edge, the at least one notch extending perpendicular to the longitudinal edge, through the first surface and the first lip and partially into the second lip. The at least one notch has a depth at the first surface which is greater than the depth of the groove. The width of the longitudinal tongue is greater than the depth of the longitudinal groove, such that, when the longitudinal groove of the tongue and groove board is interfaced with a longitudinal tongue of an adjacent tongue and groove board, a drain path is formed between the boards, the drain path including the at least one notch in the first longitudinal edge.

According to another embodiment, a tongue and groove board is disclosed, comprising a first surface and a second surface, a first longitudinal edge and a second longitudinal edge, first means defining a groove disposed along the first longitudinal edge, second means defining a tongue disposed along the second longitudinal edge and drainage means for providing a drainage path from the first surface to the second surface, the drainage means being disposed in the first longitudinal edge.

According to yet another embodiment, a method of forming a tongue and groove board from a board having a first surface, a second surface, a first longitudinal edge and a second longitudinal edge is disclosed. The method comprises the steps of forming a longitudinal groove along the first longitudinal edge of the board, the longitudinal groove having first and second lips cooperating to define the groove therebetween, forming a longitudinal tongue along the second longitudinal edge of the board and cutting a number of notches into the groove by cutting into the first surface, through the first lip and partially into the second lip, without cutting into the second surface of the board.

DETAILED DESCRIPTION

Figure 1:
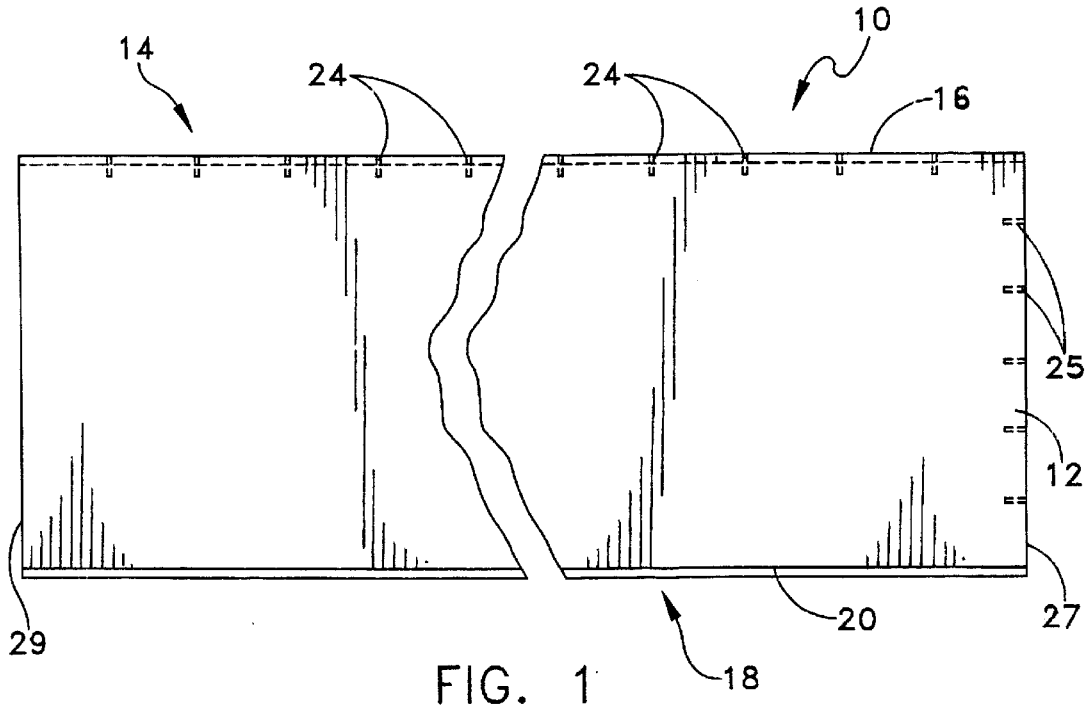
FIG. 1 is a plan view of a tongue and groove board showing one embodiment of the present invention.

The tongue and groove board of the present invention is illustrated and generally indicated at 10 in FIG. 1. As will hereinafter be more fully described, the tongue and groove board 10 includes improved features which enable a quick-draining sub-floor to be constructed.

Figure 2:
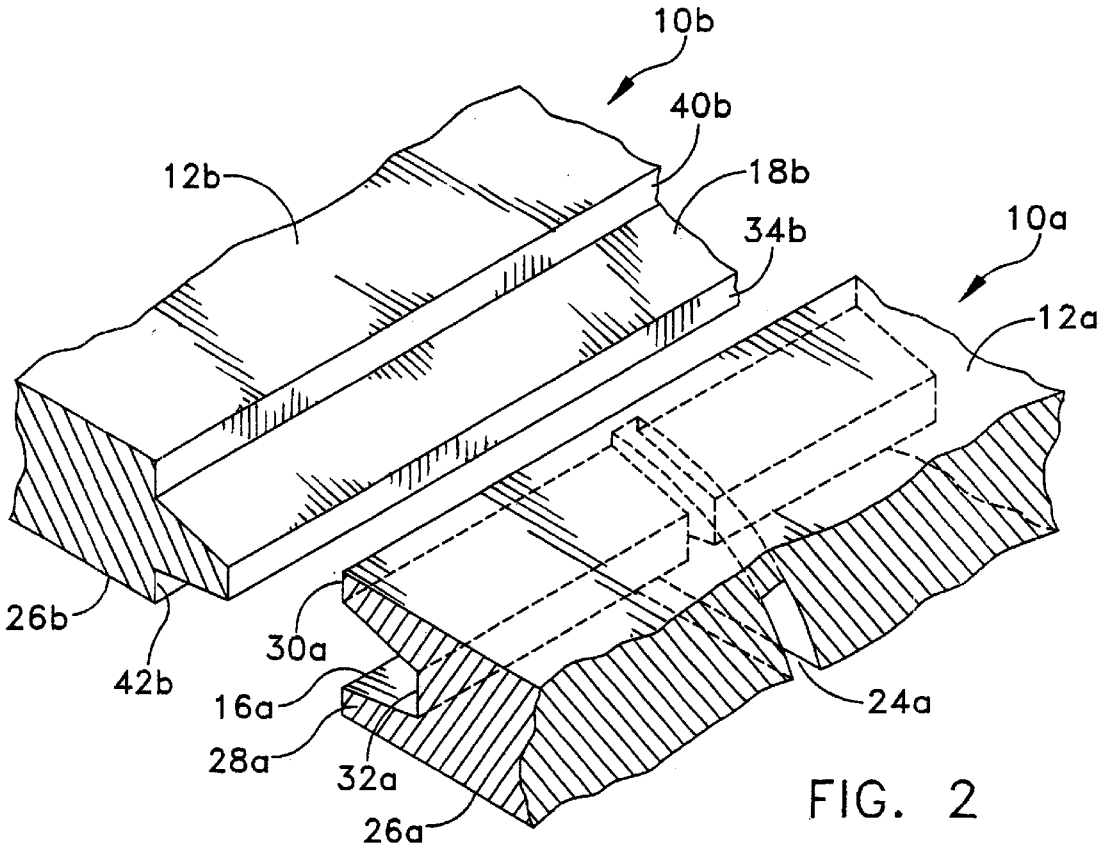
FIG. 2 is a perspective view of the tongued longitudinal edge and the grooved longitudinal edge, including a notch in the groove, in accordance with the present invention, the two edges being separated from each other.

Shown in FIG. 1 is a plan view of a tongue and groove board 10 having an upper board surface 12, a lower board surface (not shown), a first longitudinal edge 14 having a longitudinal groove 16, shown in phantom, and a second longitudinal edge 18 having a longitudinal tongue 20. Drain notches 24, shown in phantom, are perpendicularly cut into the first longitudinal edge 14 at spaced intervals along edge 14. As will be described in greater detail below, notches 24 are cut into board 10 through the bottom surface and the groove 16, but do not extend through upper surface 12. Drain slots 25 are perpendicularly cut into a transverse edge 27 at intervals spaced along transverse edge 27. Drain slots 25 extend upward from the lower surface and partially into the board, but do not penetrate all the way through to upper surface 12. Board 10 also includes a transverse edge 29. Board 10 may be formed from any suitable material including plywood, particle board, wafer board and strand board FIG. 2 is a perspective view of a portion 10*a* of a first longitudinal edge 14*a* of a tongue and groove board 10 and a portion 10*b* of a second longitudinal edge 18*b* of a separate tongue and groove board 10. Portion 10*a* shows an upper surface 12*a*, a lower surface 26*a* and a groove 16*a*, shown partially in phantom, formed between a first lip 28*a* and a second lip 30*a*. Groove 16*a* includes a groove base 32*a* and second lip 30*a* includes a lip surface 31*a*. A notch 24*a* is shown, partially in phantom, which extends through the lower surface 26*a* and the first lip 28*a* and partially into the second lip 30*a*. Portion 10*b* shows an upper surface 12*b*, a lower surface 26*b* and a tongue 20*b* formed along longitudinal edge 18*b*, the tongue 20*b* having a tongue face 34*b*. A surface 40*b* of longitudinal edge 18*b* extends perpendicularly from upper surface 12*b* to tongue 20*b* and a surface 42*b* extends perpendicularly from lower surface 26*b* to tongue 20*b*.

Figure 3:
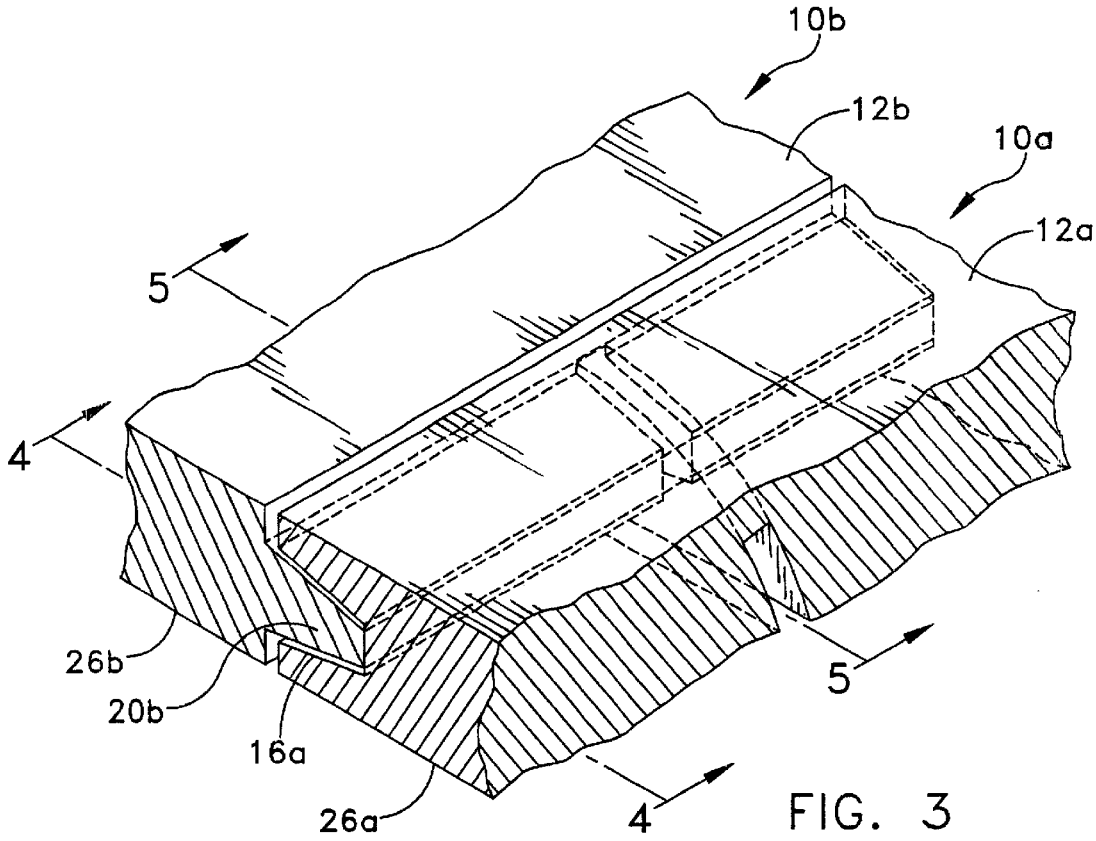
FIG. 3 is a perspective view of the tongued longitudinal edge and the grooved longitudinal edge, including a notch in the groove, in accordance with the present invention, the two edges being interfaced with each other.
Figure 4:
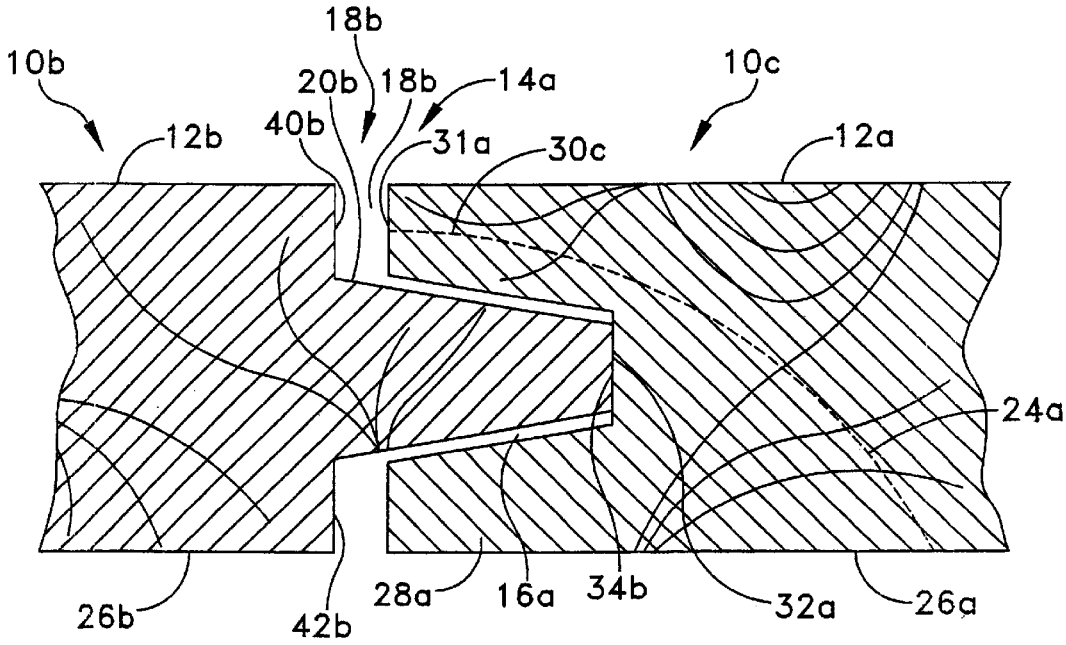
FIG. 4 is a cross-sectional view of the tongue and groove board of the present invention, taken along line 4—4 of FIG. 3.
Figure 5:
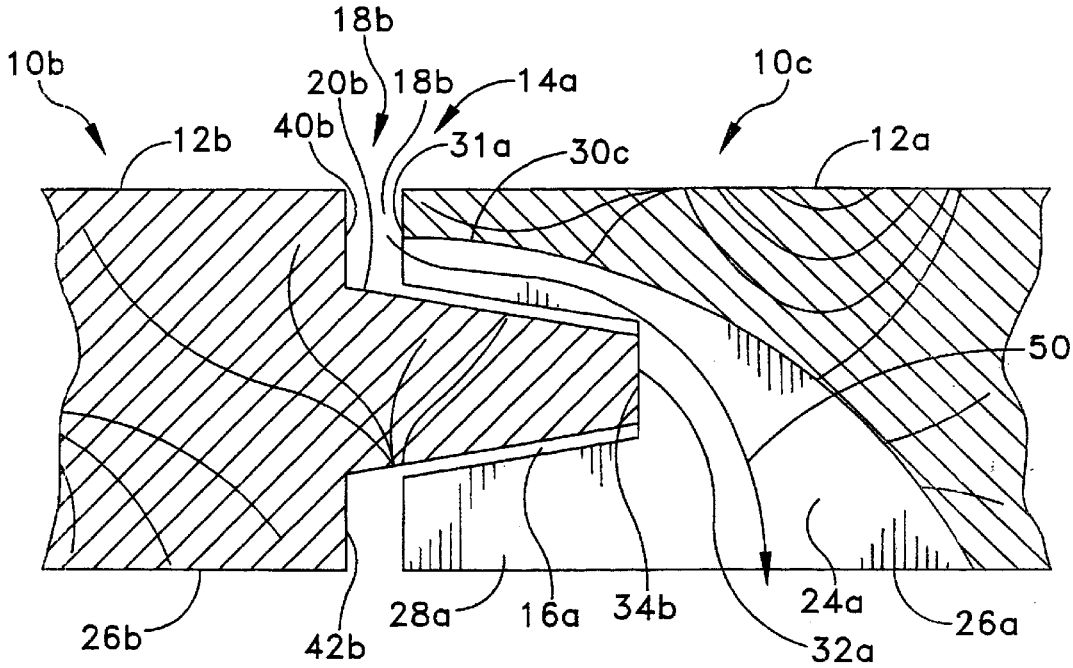
FIG. 5 is a cross-sectional view of the tongue and groove board of the present invention, taken along line 5—5 of FIG. 3.

FIG. 3 is a perspective view of portion 10*a* and portion 10*b* showing tongue 20*b* inserted into groove 16*a*. FIG. 4 is a cross sectional view of the connection of portions 10*a* and 10*b* shown in FIG. 3, taken along line 4—4 of FIG. 3. FIG. 5 is a cross sectional view of the connection of portions 10*a* and 10*b* shown in FIG. 3, taken along line 5—5 of FIG. 3. FIG. 4 shows notch 24*a* in phantom and FIG. 5 shows notch 24*a* in cross-section. As shown in FIG. 5, notch 24*a* extends through lower surface 26*a*, first lip 28*a* and notch 16*a* and partially into second lip 30*a*. In a preferred embodiment, notch 24*a* has a depth at surface 26*a* which is at least twice the depth of groove 16*a*. Notch 24*a* has a curved profile which extends from lower surface 26*a* to a midpoint of lip face 31*a*. A tangent of notch 24*a* at the intersection point of the outer surface of notch 24*a* and lip surface 31*a* is perpendicular to lip surface 31*a*.

As can be seen in FIGS. 4 and 5, the width of tongue 20*b* is greater than the depth of groove 16*a*. The connection of two adjacent tongue and groove boards, shown by portions 10*a* and 10*b* in FIG. 3, results in a drainage gap 36 being formed between lip surface 31*a* of first lip 30*a* of longitudinal edge 14*a* and surface 40*b* of longitudinal edge 18*b*. Drainage gap 36 and notch 24*a* cooperate to provide a drain path, shown by arrow 50, which enables water accumulated on surfaces 12*a* and 12*b* to drain from surfaces 12*a* and 12*b*.

Figure 6:
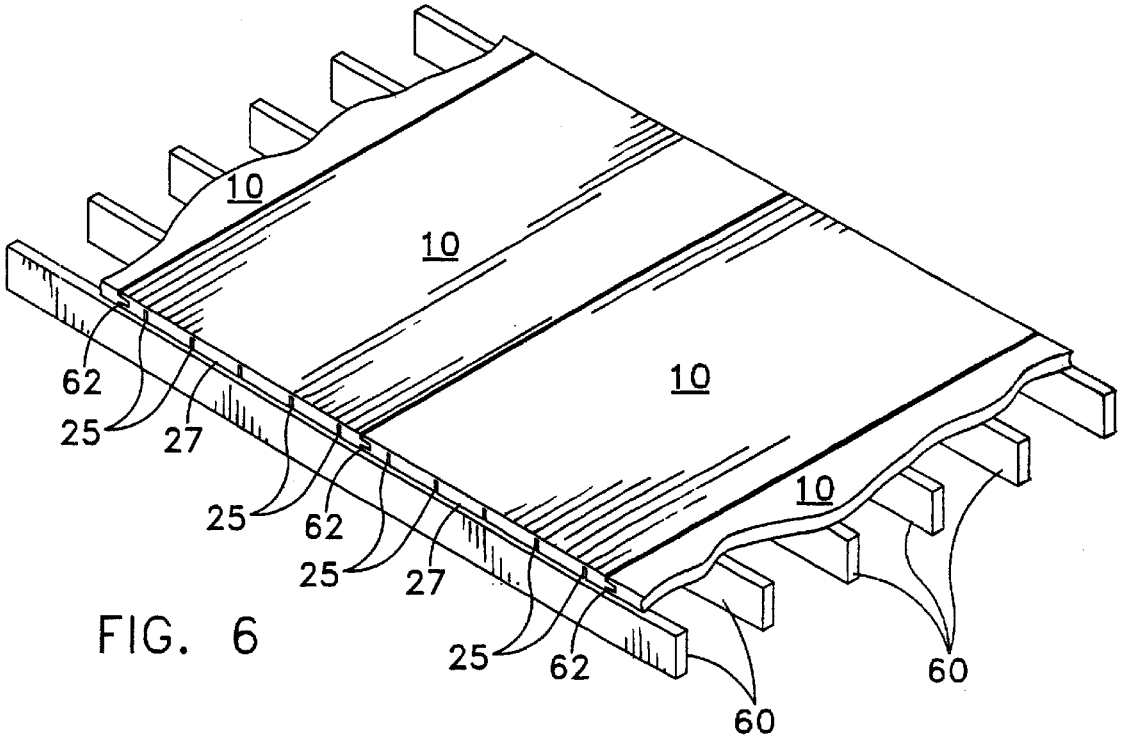
FIG. 6 is a perspective view of a plurality of boards interconnected and mounted on joists in accordance with the present invention.

FIG. 6 is a perspective view of a number of boards 10 being connected together and mounted on a plurality of floor joists 60 and 60*a*. Boards 10 span several floor joists 60 and 60*a* and are connected together at tongue and groove connections 62. Boards 10 are oriented on floor joists 60 such that drainage slots 25 are located along a floor joist 60*a*. As described above, drainage slots 25 are cut into transverse edge 27 upward through the lower surface of the board, resulting in a slot having a height which is approximately half the thickness of the board and a depth which is greater than half the width of the floor joist 60*a* which supports transverse edge 27. The boards are installed on the floor joists with a gap of approximately ⅛" between adjacent transverse edges. This enables water to drain through the gap between the transverse edges and drainage slots 25, away from floor joist 60*a*, when transverse edges of adjacent boards (not shown) are mounted to floor joist 60*a* and abut transverse edges 27 of the boards 10.

In a preferred embodiment, the tongue and groove board of the present invention is formed as follows. First, a board having opposing longitudinal edges is cut to include a groove on one longitudinal edge and a tongue on the other longitudinal edge, in a manner known in the art. A ⅜" wide, 5" diameter circular saw is then used to cut each notch 24 into longitudinal edge 14. As shown in FIG. 5, notch 24*a* is cut such that a tangent at the intersection point of the outer surface of notch 24*a* and lip surface 31*a* is perpendicular to lip surface 31*a*. Each notch 24 of board 10 may be cut individually or a predetermined number of notches 24 may be cut along a board at predetermined intervals simultaneously, using a corresponding predetermined number of saws. As described above with reference to FIGS. 2–5, notches 24*a* are cut into the lower surface 26*a* of the board, through the first lip 28*a* and the groove 16*a* and partially into the second lip 30*a* to a midpoint of the lip surface 31*a* of the second lip 30*a*.

The present invention includes a tongue and groove board drainage system which provides improved drainage capabilities over the drainage system disclosed in U.S. Pat. Nos. 5,182,892 and 5,335,473 to Chase. As discussed above, in the system of Chase, water must first pass through a narrow gap before it reaches the notches in the tongue portion of the board. Once passing through the notches in the tongue, the water must pass through a second narrow gap, which impedes the flow of water through the system. The present invention provides a drainage system which more effectively enables water to quickly drain from the upper surface of the boards. Once water enters drainage gap 36, it drains directly through notches 24 rather than having to drain through another narrow gap. Since notches 24 is in groove 16 and has a depth which is at least twice the depth of the groove, a larger area is provided to enable water to quickly drain from the upper surfaces of adjacent boards.

As described above, the present invention enables water to drain quickly from the upper surface of the sub-floor. The ability to quickly remove water from the upper surface greatly reduces any water absorption into the sub-floor, which reduces the possibility of the sub-floor rotting, buckling or otherwise being damaged due to the absorption of water.

While there is shown and described herein certain specific structure embodying the invention, it will be manifest to those skilled in the art that various modifications may be made without departing from the spirit and scope of the invention. For example, although notch 24 is shown and described as having a curved profile formed by a circular saw, it will be understood that any similar method of cutting notch 24 may be used and, consequently, the shape of notch 24 may differ, depending on the cutting method used. Furthermore, any number of notches may be cut along the grooved edges, and the spacing between notches may be varied from that shown. The notches may be wider or narrower than disclosed and may be formed using a different size saw than disclosed. Therefore, the invention is not limited to the particular forms herein shown and described except insofar as indicated by the scope of the appended claims.

What is claimed is:

1. A tongue and grove board comprising:

a first surface and a second surface;

a first longitudinal edge and a second longitudinal edge;

a first transverse edge and a second transverse edge;

said first longitudinal edge having a first longitudinal lip and a second longitudinal lip cooperating to form a longitudinal groove therebetween, said longitudinal groove having a depth;

said second longitudinal edge having a longitudinal tongue disposed therealong, said longitudinal tongue having a width; and at least one notch disposed in said first longitudinal edge, said at least one notch extending perpendicular to said longitudinal edge, through said first surface and said first lip and partially into said second lip.

2. The tongue and groove board of claim 1, wherein said at least one notch has a depth at said first surface which is greater than the depth of said groove.

3. The tongue and groove board of claim 1, further comprising at least one slot disposed in said first transverse edge, said at least one slot extending perpendicular to said first transverse edge.

4. The tongue and groove board of claim 1, wherein said width of said longitudinal tongue is greater than said depth of said longitudinal groove, such that, when said longitudinal groove of said tongue and groove board is interfaced with a longitudinal tongue of an adjacent tongue and groove board, a drain path is formed between said boards, said drain path including said at least one notch in said first longitudinal edge.

5. A tongue and groove board comprising:

a first surface and a second surface;

a first longitudinal edge and a second longitudinal edge;

a groove disposed along said first longitudinal edge, said groove being defined by a first lip and a second lip disposed in a parallel relationship along said first longitudinal edge;

a tongue disposed along said second longitudinal edge; and a drainage path from said first surface to said second surface, said drainage path comprising at least one notch cut into said first longitudinal edge;

wherein said notch extends substantially perpendicular to said first longitudinal edge from said first surface, through said first lip and partially into said second lip.

6. The tongue and groove board of claim 5, said notch having a curved profile, wherein a tangent to an apex of said curved profile is perpendicular to a face surface of said second lip at an intersection of said curved profile and said face surface of said second lip.

7. The tongue and groove board of claim 6, wherein said notch has a depth at said first surface which is greater than a depth of said groove.

8. The tongue and groove board of claim 7, wherein a width of said tongue is greater than said depth of said groove, such that, when a tongue of an adjacent tongue and groove board is inserted into said groove, a drainage gap is formed between said boards, said drainage gap and said notch cooperating to provide a drainage path for liquid from said second surface to said first surface.

* * * * *